United States Patent [19]

Vinciguerra

[11] 4,008,888

[45] Feb. 22, 1977

[54] DEVICE FOR THE TRANSPORT OF INDIVIDUAL PIECES OF FABRIC IN THE AUTOMATIC MANUFACTURE OF PRODUCTS THEREFROM

[75] Inventor: Costantino Vinciguerra, Florence, Italy

[73] Assignee: Nuovo Pignone, S.p.A., Florence, Italy

[22] Filed: Feb. 20, 1974

[21] Appl. No.: 444,117

[30] Foreign Application Priority Data

Feb. 20, 1973 Italy ..... 20575/73

[52] U.S. Cl. ..... 271/18.3; 214/1 BB; 294/61

[51] Int. Cl.² ..... B66C 1/58

[58] Field of Search ..... 294/61; 214/1 B, 1 BB, 214/152, 1 BC, 1 BD; 271/18.3

[56] References Cited

UNITED STATES PATENTS 3,402,833 9/1968 Pershing ..... 294/61 X

*Primary Examiner*—Robert J. Spar
*Assistant Examiner*—George F. Abraham
*Attorney, Agent, or Firm*—Ralph M. Watson

[57] ABSTRACT

A device is provided for incorporation in apparatus for the automatic manufacture of articles from fabric by cutting the fabric into sets of single pieces and then moving the individual pieces of a set to a work station at which the pieces are sewed to each other, which comprises: a movable hollow frame, a flat plate which has a centrally disposed opening and which is adapted to be forced downwardly against the upper surface of a piece of fabric; a connection between the plate and the frame; an elongated oscillatory needle holder supported at its lower end by the frame along an axis of rotation located above the opening in the plate; a needle having a curved sharply tapered lower end and a stem; a connection between the stem and the needle holder at a point above the lower end of the needle holder whereby oscillation of the needle holder will cause the sharply tapered end of the needle to swing through the opening in the plate along an arc; and means are provided for adjusting the location of the arc so that the tapered end of the needle is caused to penetrate the fabric to a predetermined depth.

2 Claims, 6 Drawing Figures

DEVICE FOR THE TRANSPORT OF INDIVIDUAL PIECES OF FABRIC IN THE AUTOMATIC MANUFACTURE OF PRODUCTS THEREFROM

This invention relates to the automatic manipulation of pieces of fabric during the manufacture of articles such as clothing.

More particularly, the invention relates to a procedure for separating and removing pieces of fabric from a pile of cut parts, transporting these pieces to a work station and holding them in position or moving them in a controlled manner during the automatic manufacture of articles therefrom.

The invention relates also to a device for carrying out this procedure.

In the commercial manufacture of articles of clothing, the pieces of fabric which have been cut to suitable shapes and sizes are generally transported between successive operations in piles or bundles of parts which are similar in size and shape.

By "pieces of fabric" is meant here and subsequently in this description both single pieces such as those which come directly from the cutting room and also sub-units of pieces which have undergone operations of transformation in the sewing room.

One of the first problems which is encountered in the designing of automatic machines for carrying out operations in the manufacture of articles of clothing is the separation and automatic removal of pieces of fabric from a pile or bundle of pieces, without the manual intervention of an operator, and the automatic transport of such pieces to an exactly determined position at a work station.

In order that these operations of separation, removal and transport may be brought about in a satisfactory manner, it is necessary that the procedure used permit that:

1. one piece may be removed at a time from the feed pile;
2. the remaining pieces in the pile shall not be displaced or moved in any way during that removal operation;
3. the removed piece may be transferred without introducing tensions, so that it is deposited in an exactly determined position, from which it does not move.
4. The procedure, and also the foregoing device which carries it out, must be adapted for use with a vast range of fabrics, which may differ from each other with respect to thickness, weight and physical surface characteristics.

A second problem is that of the removal of a piece of fabric from a work surface and its automatic manipulation during an operation of manufacture.

The device used for this purpose must:

1. be adapted to remove a single piece whose thickness which may vary within a vast range of values, from a pile or from a work surface;
2. ensure a firm grip on the piece so that uncontrolled movements of the piece during automatic operations are prevented;
3. be of a shape and size which will not interfere with the movements and working strokes of the tool carrying members (sewing machines, hemmers, ironing members, etc.)

To solve these two problems, procedures were originally suggested which were based on the use of pneumatic suction. The devices for carrying out these procedures, however, have the serious disadvantage of being extremely sensitive to the characteristics of the fabric (weight, thickness, type of yarn), the compactness of the pile from which removals are made and the adhesion between one layer of the pile and the next.

As an alternative procedures were resorted to which were based on the use of needle-shaped elements which cross the piece to be removed from opposite directions and at a slight angle of inclination with respect to it. However, the devices used to effect this are difficult to adjust to changes in the type of fabric, and have the serious limitation of working satisfactorily only when the parts to be removed are relatively thick. The layers of the pile must also have special physical characteristics which prevent a too close contact between one layer and the next.

The said devices can be used in the case of ribbed fabrics or perforated fabrics such as are used for making underwear, but they cannot be used for the great majority of the fabrics used for the manufacture of clothes.

Finally, there have also been suggested procedures based on the successive use of mechanical and pneumatic effects; for example a tangential friction effect on the piece to be removed, a compression on the pile of remaining pieces, and a pneumatic suction.

A device based on these principles uses, for example, a roller having a high coefficient of friction to induce the lifting of an edge of the first piece in the pile, a series of pressure feet to exert compression on the pieces below it and prevent them from moving, and a suction head to lift the said first piece by means of vacuum suction.

Devices of this sort, which are of marked mechanical complexity and very expensive, do not, however, work satisfactorily when the physical characteristics of the fabric vary between one pile and the next or even within the same pile of parts, as often occurs in the normal process of manufacturing articles of clothing.

All the methods mentioned above have severe limitations in cases where the pieces of fabric are arranged in the pile alternately face up and face down ("face to face" arrangement), especially if the fabrics present marked physical differences between the "front" and the "back" sides.

The first object of my invention is to supply a procedure and a device for the automatic execution of the operations of separation, removal and transport, for almost all the fabrics in use today in the clothes manufacturing industry, capable of being used indifferently for piles of pieces of fabric which are either face up or face down, and also for piles of pieces alternately face up and face down.

The second object of my invention is to supply a procedure for the automatic manipulation of pieces of fabric during manufacture, which can be carried out by devices of low cost, which are easy and reliable to run, and which do not interfere with the movement of the members carrying the work tools.

The practice of my invention is characterized by the use of needle-shaped elements which are curved, and adapted to penetrate the fibers of the fabric to a set depth, and which can be controlled with precision and adjusted at will.

The device which effects this consists in means for exercizing a uniform pressure on the pile of cut parts from which the piece is to be removed, and the means for separating and lifting the piece at the top of the pile from those below, without moving or in any way displacing the other pieces in the pile which are to be removed subsequently.

According to the invention, the separation and removal of the pieces of fabric are achieved by the use of a series of tapering and curved needles, mounted on oscillating members in such a way that during the oscillation of the said members the points of the needles describe curving (usually circular) trajectories set on planes normal to the surface of the fabric.

The device according to the invention offers the advantageous feature of being adapted for use alternatively either for the removal of pieces from a pile, or for the removal of pieces from a work surface and the subsequent manipulation during manufacturing operations.

The conversion from the one to the other running condition can be effected rapidly by means of a simple manual adjustment.

The first running condition is preferably to be used when the device is intended for separating and removing pieces of fabric from a pile. In this case the relative positions of the oscillating members carrying the curved needles and the piece of fabric on which they are acting are such that, as a result of the oscillation of the said members, the points of the needles cross the fibers of the piece of fabric only over a fraction of its thickness.

It is possible in this way to act only on the first layer of the pile without disturbing the layers below. Under particular conditions, which will be treated in greater detail below, an action of separation of the layers is created which is not affected by the thickness of the layers themselves.

The second running condition is preferably to be used when the device performs the removal of parts from a work surface and/or carries out manipulation during automatic operations. In this case the relative positions of the oscillating members carrying the curved needles and the piece of fabric are such that, as a result of the oscillation of the said members, the points of the needles completely cross the thickness of the fabric, come out on the opposite side and then return into it.

In this case also, as will become clear, it is possible to operate so that the action of the device is not affected by the thickness of the fabric on which it is acting.

For further explanation, reference is now made to the attached drawings, which illustrate in diagrammatic form some preferred but not limitative forms of apparatus for carrying out my invention.

Figure 1:
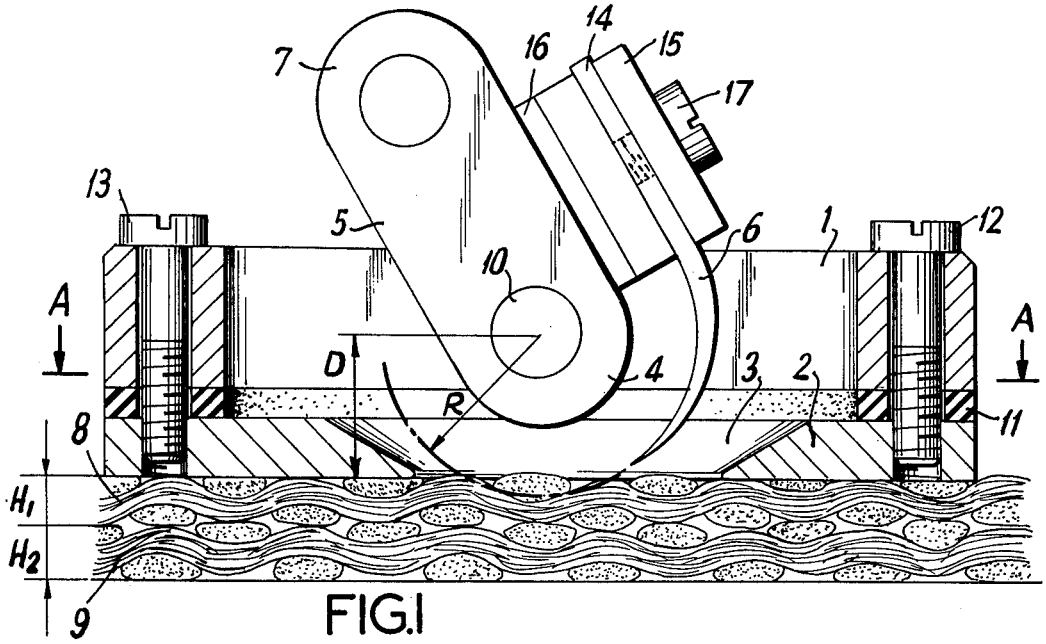
FIG. 1 is a diagrammatic view in longitudinal cross-section, on a greatly magnified scale as compared to the real dimensions of the device, in the resting position.
Figure 2:
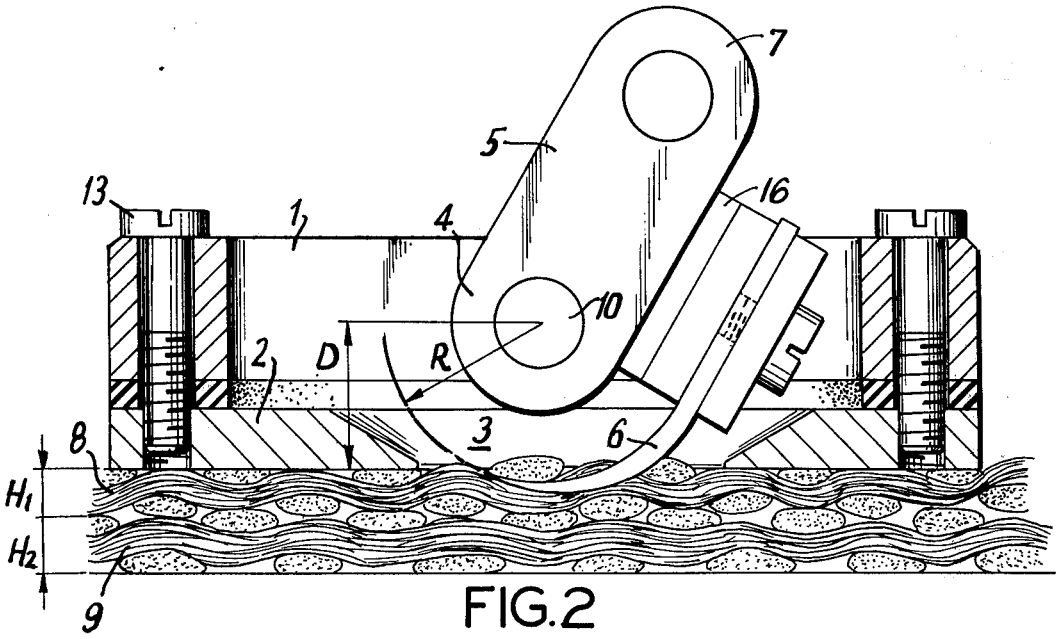
FIG. 2 is a similar view to FIG. 1 of the device in the removal position.
Figure 3:
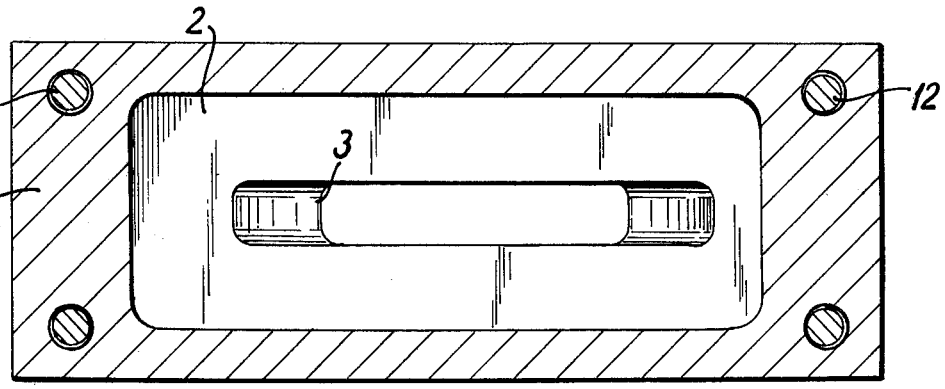
FIG. 3 is a view in horizontal cross-section along the line A-A of FIG. 1.

In the apparatus illustrated in FIGS. 1–3 a hollow frame 1, faces a flat plate 2 which has in its central area a through opening 3.

Screw members 12, 13 connect the hollow frame 1 to the plate 2 with an interposed elastic gasket 11. Inside the hollow frame 1 is set the end 4 of an elongated oscillating member 5, the other end 7 of which is connected to an operating member not shown in the figure.

A jaw element 15, connected to the oscillating member 5 by means of a screw element 17, with an interposed gasket 16, is integral having the stem 14 of a needle 6 with a curved and highly tapered point.

10 represents the axis of rotation of the member 5 with R the distance between the said axis of rotation and the point of the curved needle 6, and with D the distance between the axis 10 and the lower face of the plate 2.

The distances R and D can be adjusted within a limited range, operating on the screw elements 17 and 12, 13 respectively to change the deformation of the corresponding elastic gaskets 16 and 11.

Below the plate 2 are represented the two top pieces 8, 9 of a pile of pieces of fabric, having respectively the thicknesses $H_1$ and $H_2$.

When the device is in the resting condition, the end 7 of the member 5 is turned to the left (FIG. 1) and the point of the needle 6 is slightly above the lower face of the plate 2.

When it is desired to automatically remove a piece of fabric from a pile of pieces, the device is brought up to the top of the pile and pressed against it (FIG. 1). The flat plate 2 transmits to the fabric an effect of compression on the fibers in the area surrounding the opening 3. The fibers of the piece 8 and the pieces immediately below are practically flat even over the opening 3, thanks to its small size.

To effect the separation and the removal of the piece 8 from the pile, the end 7 of the oscillating member 5 is moved toward the right, maintaining at the same time the pressure on the pile of pieces.

The oscillating member 5 rotates around the axis 10 and the curved needle 6 integral with it penetrates the fabric, crossing the fibers over a fraction of its thickness (FIG. 2).

It is important to note that at this point the only action being exercized on the pieces of fabric below piece 8 is an action of compression, practically uniform, normal to the surface of the said pieces.

The subsequent lifting of the device induces the lifting of the piece of fabric 8, hooked to the end of the curved needle 6, without causing tangential effects on the pieces below in the pile, and thus without causing movements of the said pieces with respect to the supporting surface.

The action of the needle 6 crossing some fibers of the fabric is sufficient to overcome the weight of the piece and to keep it hanging in an exactly determined position with respect to the plate 2.

The piece 8 can thus be transported to the desired position, and there unloaded, by rotating in an anticlockwise direction the end 7 of the member 5, so as to cause the extraction of the point of the needle 6 from the fibers of the fabric.

The fabric is not damaged in any way and no visible traces of the needle's action remain.

The device is brought back to the starting position and the cycle is repeated for the separation, removal and transport of the following piece 9 which is now at the top of the pile.

For correct functioning in removal from a pile of pieces, it is obviously necessary that the thickness of penetration of the needle shall not exceed the thickness of the layer of fabric. I.e. the following conditions must at the same time occur:

1. $R > D\ R < (D + H)$

H being the thickness of a generical layer of the pile. Introducing the minimum thickness, H min, of fabric which may be encountered in a generical pile, 1) becomes 2. $R > D\ R < (D + H_{min})$.

It turns out in practice that these conditions can be fulfilled even in the case of extremely fine fabrics, such as silk, and in general with fabrics having a thickness of about one tenth of a millimeter. This category includes practically all fabrics which have been used in manufacturing clothes.

In practical tests it has also been found that the best performances are achieved when 3. $R = D + k\ H_{min}$ with $k$ between 0.7 and 0.9.

Since R and D can be adjusted separately by operating on the screw elements 17 and 12, 13 respectively while setting the device, once the minimum thickness of the fabrics which will be met during a particular manufacturing process is known it is easy to make sure that 3) will occur.

Thanks to the small dimensions of the device, it is possible to contain the mechanical clearances of the moving parts within very narrow limits, without it being necessary to resort to special and expensive processes.

Figure 4:
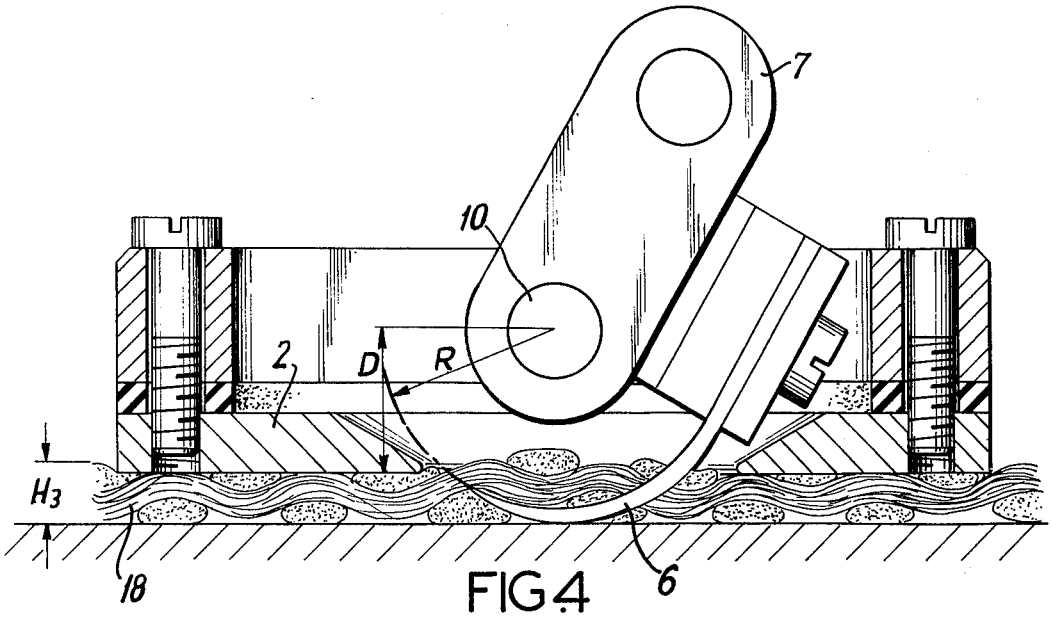
FIG. 4 is a view in longitudinal cross-section of the device in the previous figures, in a particular application.

With reference to FIG. 4, a second form of use of the device will now be described, which is particularly useful for the removal of single pieces of fabric (not in piles).

The necessity for this occurs, for example, when automatic operations are being performed which include a sequence of elementary stages in succession, without the necessity for intermediate collecting of semi-processed parts in the form of piles or bundles of pieces. Since during operation external stresses occur which may be considerable, it is desirable for the grip of the curved needle 6 to be exerted upon to the fibers over the whole thickness $H_3$ of the fabric 18, in order to offer greater resistance.

It is thus desired that the curved needle 6 goes right through the fabric 18, comes out on the opposite side and goes back into the fabric.

This is now possible, thanks to the fact that the fabric is resting on a flat surface and there are no layers below which could interfere with correct removal.

The necessary condition is now:

4. $R > (D + H_{max})$ $H_{max}$ being the maximum thickness of the pieces of fabric being worked on. In practice it is convenient to set R and D so as to bring about 5. $R = D + h\ H_{max}$ with $h$ between 1.1 and 1.3.

Figure 5:
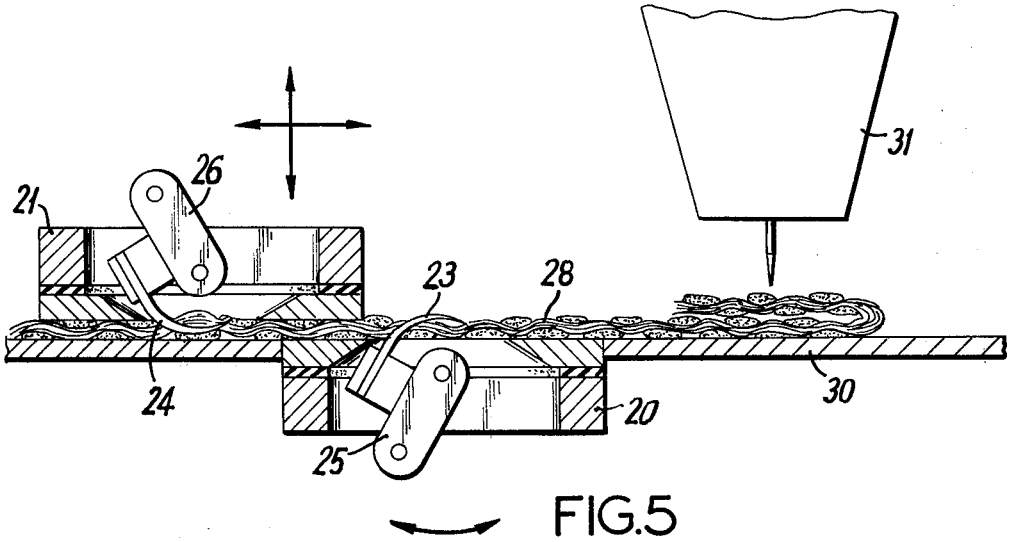
FIG. 5 is a view in longitudinal cross-section, on a reduced scale as compared to the previous figures, of a particular form of application which uses two elements according to the invention.

FIG. 5 represents two slides 20, 21 of the invention, in action on a piece of fabric 28 resting on the work surface 30. The element 21 can move vertically and horizontally with respect to the work surface 30, while the element 20 is fixed and has its opening on a level with the work surface 30.

The oscillating parts 25, 26 of the elements 20, 21 can rotate, in the same way as described with reference to the previous figures, carrying the corresponding curved needles 23, 24 to be put in and taken out among the fibers of the piece of fabric 28.

31 represents diagrammatically an operating head, for example a sewing machine of traditional type.

The element 21 removes the piece of fabric 28 from a pile or from a previous work station, and places it on the work surface 30. The piece 28 is firmly gripped also by the needle 23 of the element 20 which keeps it locked in a fixed position with respect to the surface 30. FIG. 5 represents this particular stage of the sequence.

Then the needle 23 is withdrawn and the element 21 can carry out the return stroke coming into the removal position for a fresh piece. The operating head 31 comes into the work position and performs the desired operation while the piece 28 is held still against the surface 30.

A new element the same as element 21 performs the removal of the piece of fabric 28 at the end of the operation, and, after the withdrawal of the needle 23, transports the said piece 28 to a further operation.

As an alternative the same element 21 could be used for this purpose.

Figure 6:
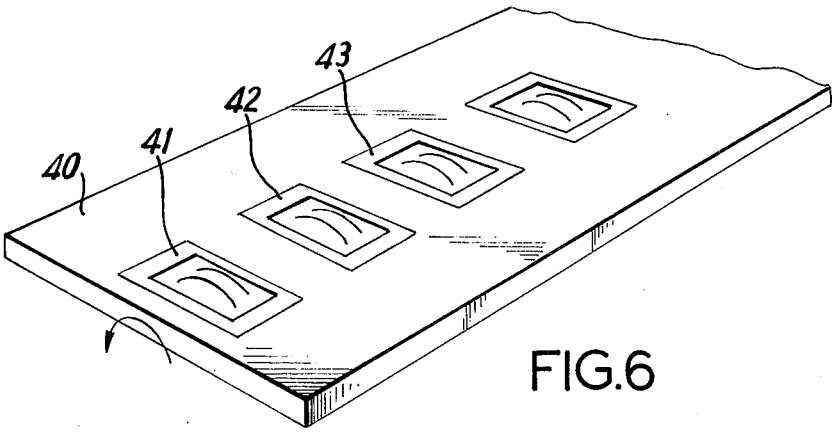
FIG. 6 is a view in perspective of a particular form of realization.

In cases where, on the other hand, it is desirable to keep still the operating head 31, it is possible to move during operations the work surface 30 and the element 20 together with the piece 28. FIG. 6 represents, as an example, a removal device 40 for large size pieces of fabric, made up of a series of elements 41, 42, 43 . . . with two needles per slit.

The device which is the subject of my invention has been described with reference to particular forms of realization illustrated in diagrammatic form; it will, however, be evident to technicians in the field than many variants and changes are possible without departing from the field it covers.

In particular, the opening through which the curved needle acts, instead of being narrow and long as shown in FIG. 3, can be practically circular or rhomboid in shape. The oscillating member can be provided with a number of needles, instead of only one or two as shown. The oscillating member can be actuated by mechanical, or pneumatic or electrical means, or by a combination of different means.

There can be present safety devices which prevent the movement of the said oscillating member in the absence of a piece of fabric to be moved, for example at the end of a pile or after a previous failure to transfer.

What I claim is:

1. Apparatus for the automatic manufacture of articles from fabric by moving cut individual pieces of a set to a work station at which the pieces are sewed to each other, wherein the improvement comprises: a movable hollow frame, a flat plate adapted to be forced downwardly against the upper surface of a piece of fabric and having a centrally disposed opening, a connection between the plate and the frame, wherein said connection between the plate and frame is adjustable and comprises, a flexible gasket located between the lower face of the frame and the upper face of the plate, and a set of plate adjustment screws extending through the frame and the gasket and engaging the plate so that rotation of said plate adjustment screws will vary the distance between the plate and the frame, thereby changing the location of said arc, an elongated oscillatory needle holder having its lower end supported by said frame along an axis of rotation located above said opening in the plate, a needle having a curved sharply tapered lower end and a stem, a connection between said stem and needle holder at a point above said lower end thereof whereby oscillation of said needle holder will cause the sharply tapered end of the needle to swing through said opening along an arc, and means for adjusting the location of said arc so that said tapered end of the needle is caused to penetrate said fabric to a predetermined depth.

2. Apparatus for the automatic manufacture of articles from fabric by moving cut individual pieces of a set to a work station at which the pieces are sewed to each other, wherein the improvement comprises: a movable hollow frame, a flat plate adapted to be forced downwardly against the upper surface of a piece of fabric and having a centrally disposed opening, a connection between the plate and the frame, wherein said connection between the stem of the needle and the needle holder is adjustable and comprises, a jaw adapted to bear against said stem, a flexible gasket located between the jaw and the needle holder, and a stem adjustment screw extending through the jaw and said gasket and engaging the needle holder so that rotation of said stem adjustment screw will vary the radius of said arc, thereby changing the location of said arc an elongated oscillatory needle holder having its lower end supported by said frame along an axis of rotation located above said opening in the plate, a needle having a curved sharply tapered lower end and a stem, a connection between said stem and needle holder at a point above said lower end thereof whereby oscillation of said needle holder will cause the sharply tapered end of the needle to swing through said opening along an arc, and means for adjusting the location of said arc so that said tapered end of the needle is caused to penetrate said fabric to a predetermined depth.

* * * * *